US005549050A

United States Patent [19]

Rhodes

[11] Patent Number: 5,549,050

[45] Date of Patent: Aug. 27, 1996

[54] LOAD CARRYING UNIT FOR A CONVEYOR SYSTEM

[76] Inventor: Arthur B. Rhodes, 3347 Campground Rd., Louisville, Ky. 40211

[21] Appl. No.: 488,748

[22] Filed: Jun. 8, 1995

[51] Int. Cl.[6] ..... B61B 10/04

[52] U.S. Cl. ..... 104/172.3; 104/172.2; 104/252

[58] Field of Search ..... 104/172.1, 172.2, 104/172.3, 249, 250, 252, 253, 88.01; 198/803.01

[56] References Cited

U.S. PATENT DOCUMENTS

| | | | |
|---|---|---|---|
| 2,894,460 | 7/1959 | Klamp . | |
| 2,965,043 | 12/1960 | Klamp | 104/88.01 X |
| 3,174,439 | 3/1965 | Edgar et al. | 104/88.01 |
| 3,357,367 | 12/1967 | Etheridge et al. | 104/172.2 |
| 3,407,751 | 10/1968 | Orwin | 104/88.01 |
| 3,789,767 | 2/1974 | Krammer | 104/172.2 |
| 3,878,793 | 4/1975 | Turner | 104/172.2 |
| 4,438,702 | 3/1984 | Rhodes | 104/172.3 |
| 4,638,740 | 1/1987 | Rhodes | 104/172.2 |
| 4,644,869 | 2/1987 | Rhodes | 104/172.2 |
| 4,702,174 | 10/1987 | Tredwell et al. | 104/172.2 |
| 4,770,285 | 9/1988 | Rhodes . | |
| 4,944,228 | 7/1990 | Rhodes | 104/172.3 |
| 4,947,978 | 8/1990 | Rhodes | 198/341 |
| 5,065,678 | 11/1991 | Rhodes | 104/172.2 X |

*Primary Examiner*—Robert J. Oberleitner
*Assistant Examiner*—Kevin D. Rutherford
*Attorney, Agent, or Firm*—Middleton & Reutlinger; Charles G. Lamb

[57] ABSTRACT

A load carrying unit including a vertically movable pin for engagement with a movable chain of a chain conveyor includes a vertically movable chain engaging pin assembly attached to a front end of a frame structure of the load carrying unit, wherein the vertically moving chain engaging pin assembly includes a cam follower and is vertically movable in response to the position of the cam follower. The cam follower is in cooperating relation with a cam which is provided with a cam surface which follows the contour of a chain guide assembly which includes the movable chain therein.

16 Claims, 7 Drawing Sheets

LOAD CARRYING UNIT FOR A CONVEYOR SYSTEM

BACKGROUND OF THE INVENTION

The invention relates to load carrying units for an endless chain conveyor system and particularly for a load carrying unit for an endless conveyor system wherein the load carrying unit moves along a substantially flat surface and the endless chain of the conveyor system is at varying elevations.

Conveyor systems utilizing chain conveyors wherein load carrying units with vertically movable pins for engagement with the links of the chain of the conveyor thereby allowing the movable chain to pull the load carrying unit along the conveying system are well known. One particular conveying system of this type is described in my U.S. Pat. No. 4,944,228. However, conveying systems which require the endless chain to be located at different elevations in a manufacturing facility while maintaining the load carrying unit at the same elevation has presented a number of problems in the conveying system and the load carrying units.

SUMMARY OF THE INVENTION

The present invention provides a solution for maintaining a load carrying unit in engagement with an endless chain in a conveyor system even though the load carrying unit is maintained at one elevation and the endless movable chain changes its elevation.

Particularly, the present invention provides a load carrying unit having a movable pin for engagement with the links of an endless conveyor chain wherein an assembly is provided to vertically adjust the pin without interfering with the engagement of the pin and the chain link in which it is engaged.

More particularly, the present invention provides a load carrying unit for selected movement along a conveying path defined by an endless conveyor chain comprising: a frame structure having a front end and a back end; floor engaging wheels rotatably attached to the frame structure; a vertically movable chain engaging pin assembly attached to said front end of said frame structure, said assembly including a chain engaging pin, a first means to vertically move said pin between a lowered chain engaged position wherein the depending end of the pin engages the conveyor chain and a raised chain disengaged position whereat the depending end of the pin is spaced above and out of contact with the conveyor chain, and a second means to vertically move said first means and said pin as a unit between a first elevation and a second elevation.

BRIEF DESCRIPTION OF THE DRAWINGS

A better understanding of the present invention will be had upon reading the following description in conjunction with the accompanying drawings in which like parts are identified by like numbers and wherein.

DETAILED DESCRIPTION OF THE PREFERRED EMBODIMENT

Figure 1:
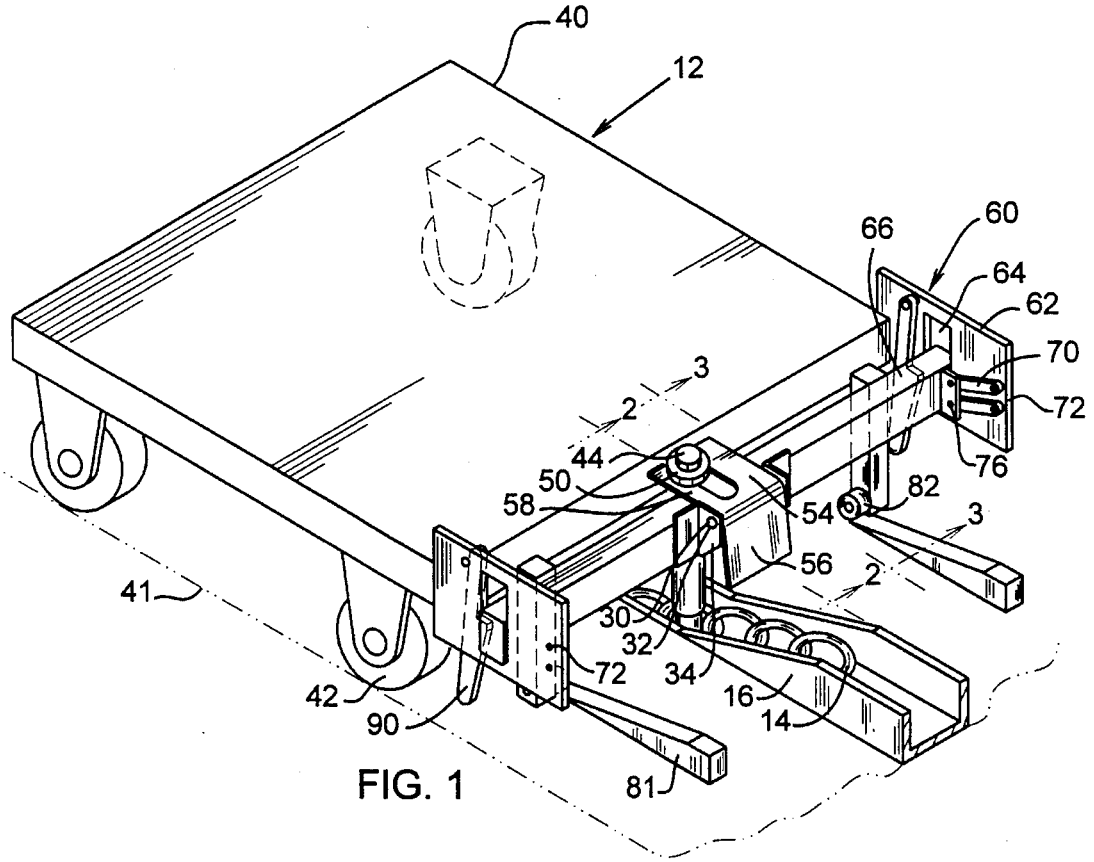
FIG. 1 is a perspective view of a preferred load carrying unit of the present invention shown in engagement with a conveyor chain.

FIG. 1 is a perspective view of a load carrying unit 12 of the present invention shown as a wheeled cart. For moving load carrying units 12 along a conveying path, a conveyor system is utilized which includes an endless chain 14 and a chain guide channel 16 which defines the conveying path for the endless chain 14. In addition to defining the conveying path, the chain guide channel 16 captures the endless chain 14 to prevent transverse movement of the chain 12 but allows the chain 14 to move linerally therealong.

The cart 12 comprises a frame structure 40 and floor engaging wheels 42 rotatably attached to the frame structure 40 and movable along the surface of a floor 41. The frame structure 40 can be of virtually any construction and configuration to support a load to be carried and conveyed on the cart 12. In one preferred embodiment as shown in FIG. 1, attached to the front end of the frame structure 40 is a vertically movable pin assembly 60 which includes a pair of spaced plates 62 attached to opposite sides of the front end of the frame structure 40. Each plate 62 is provided with a vertically elongated slot 64 therein to receive opposite ends of a movable support member 66. The movable support member 66 supports a first means for vertically moving a pin 44 for engagement and disengagement with chain 14, as discussed hereinafter.

The vertically movable support member 66 as best shown in FIGS. 2 and 2A, 3 and 3A is a rectangular shaped channel to which a first means for vertically moving the pin 44, exemplified as a movable pin activating means 52 (FIGS. 2 and 2A) is mounted on one side and a vertical pin receiving sleeve 45 on the backside of support member 66. The vertical sleeve 45 extends downwardly from the support member 66 and into the uppermost portion of the guide channel 16, the pin 44 being vertically movable within sleeve 45. The sleeve 45 is fixedly attached to the support member 66 by, for example, welding. The sleeve 45 terminates above the conveyor chain 14 and has a diameter only slightly less than the width of the guide channel 16 to provide a clearance between the sleeve 45 and the guide channel 16 so that the sleeve 45 can move linerally in the guide channel 16 as the load bearing units 12 move along with the conveyor chain 14. A portion of the movable pin 44 depends from the bottom end of the sleeve 45 so that the depending end of the pin 44 can be received in an opening of one of the horizontal lengths 24 of the conveyor chain 14.

Figure 2:
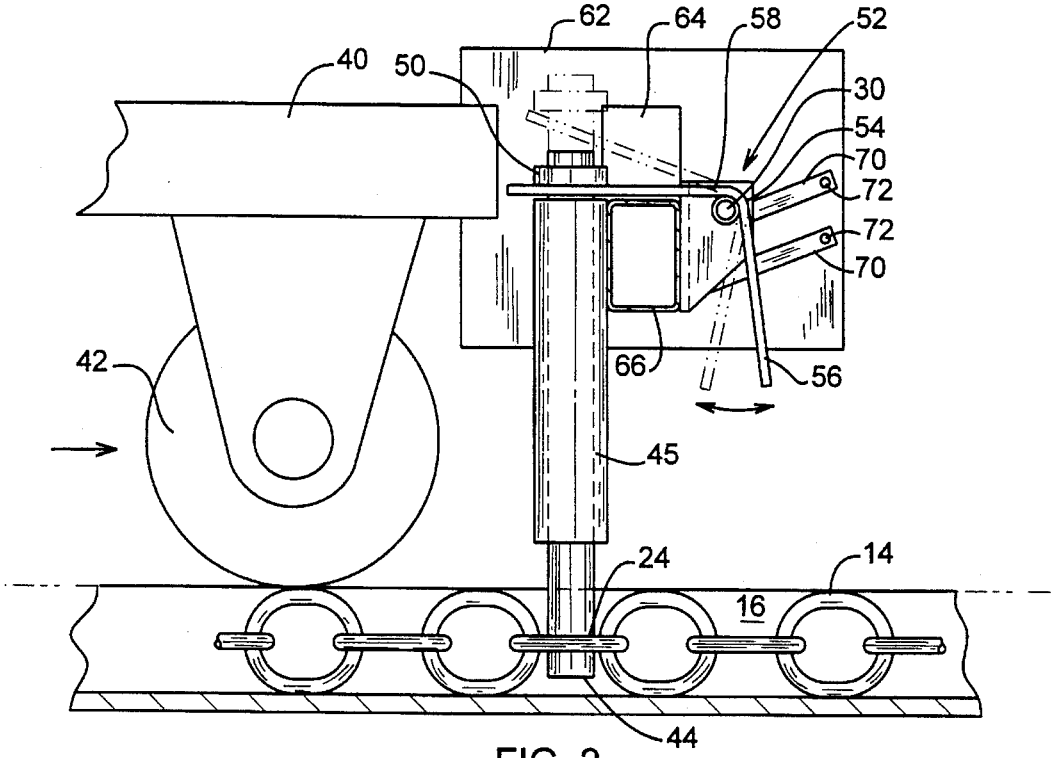
FIG. 2 is an enlarged side view of an element of the load carrying unit as seen in the direction of arrows 2—2 in FIG. 1 when the vertically movable pin assembly of the present invention is at its lowered position.
Figure 2A:
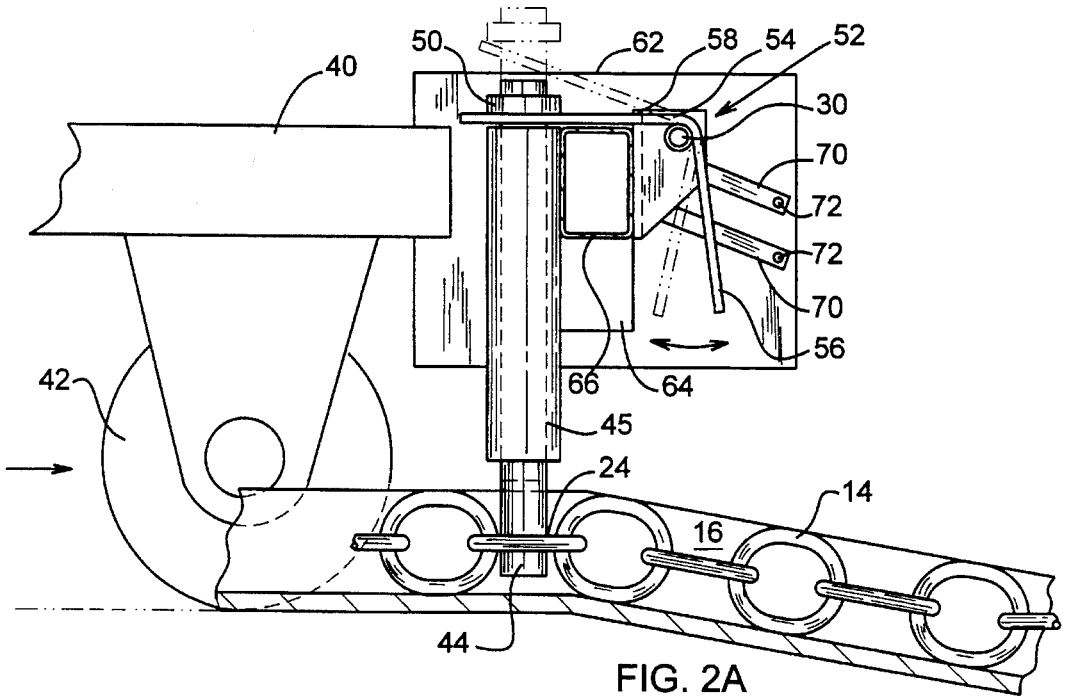
FIG. 2A is an enlarged side view of the preferred vertically movable pin assembly of the present invention of FIG. 2 when the vertically movable pin assembly is at an elevated position.

As noted previously, the depending moving conveyor chain engagement pin 44 is received within the sleeve 45 for vertical movement therein. The movable chain engagement pin 44 is movable between a lowered, conveyor chain engaged position (shown in solid lines in FIGS. 2 and 2A) and a raised, vertically disengaged position (shown in broken lines in FIGS. 2 and 2A). In the lowered, conveyor chain engagement position the depending end of the pin 44 is received, as best shown in FIGS. 2 and 2A, in the opening of one of the horizontal lengths 24 of the conveyor chain 14, and in the raised conveyor chain disengaged position the depending end of the pin 44 is spaced a distance above and out of contact with the conveyor chain 14 so that the conveyor chain 14 moves beneath the depending end of the pin 44.

The movable pin actuating means 52 is shown as comprising a pivotable right angled plate 54 pivotally mounted on the front side of the support member 66. The angled plate 54 includes a first arm 56 and a second arm 58 at a right angle to the first arm 56. A pivot axle 30 is located across the plate 54 at the junction of the first arm 56 and the second arm 58 and is affixed thereto so that the plate 54 will move with the axle 30 as it rotates. As shown in FIG. 1, the opposite ends of the axle 30 extend beyond the opposite lateral sides of plate 54 and are received in appropriate holes 32 which are disposed in plates 34 which are fixedly attached to the support member 66 and extend forwardly therefrom, the axle 30 being rotational within the holes 32. The first arm 56 depends from the axle 30 at the front of the support member 66 and the second arm 58 extends back from the axle 30 for engagement with the movable pin 44. The second arm 58 is formed with an elongated opening or slot 36 and the upwardly extending portion of the pin 44 is received in the elongated opening 36 with a pin keeper 50 located above the second arm 58 so that it is in abutment with the top side of the second arm 58 when pin 44 is in its lowered, engaged position. The conveyor engagement pin 44 is movable to the lower conveyor chain engagement position by the force of gravity.

Figure 3:
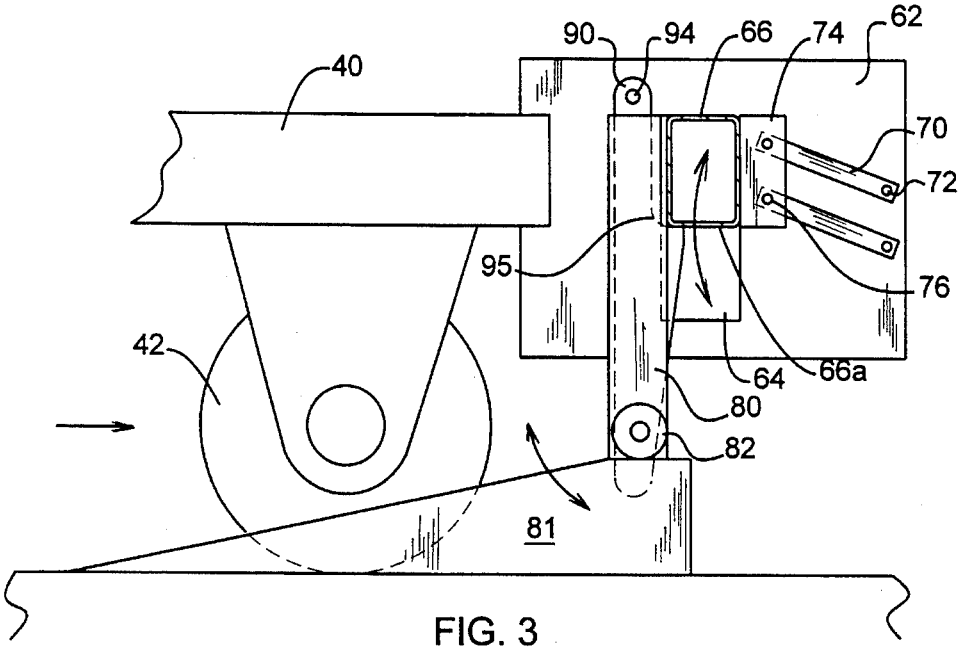
FIG. 3 is an enlarged side view of the front end of the load carrying unit as seen in the direction of arrows 3—3 in FIG. 1 when the vertically movable pin assembly is at an elevated position.
Figure 3A:
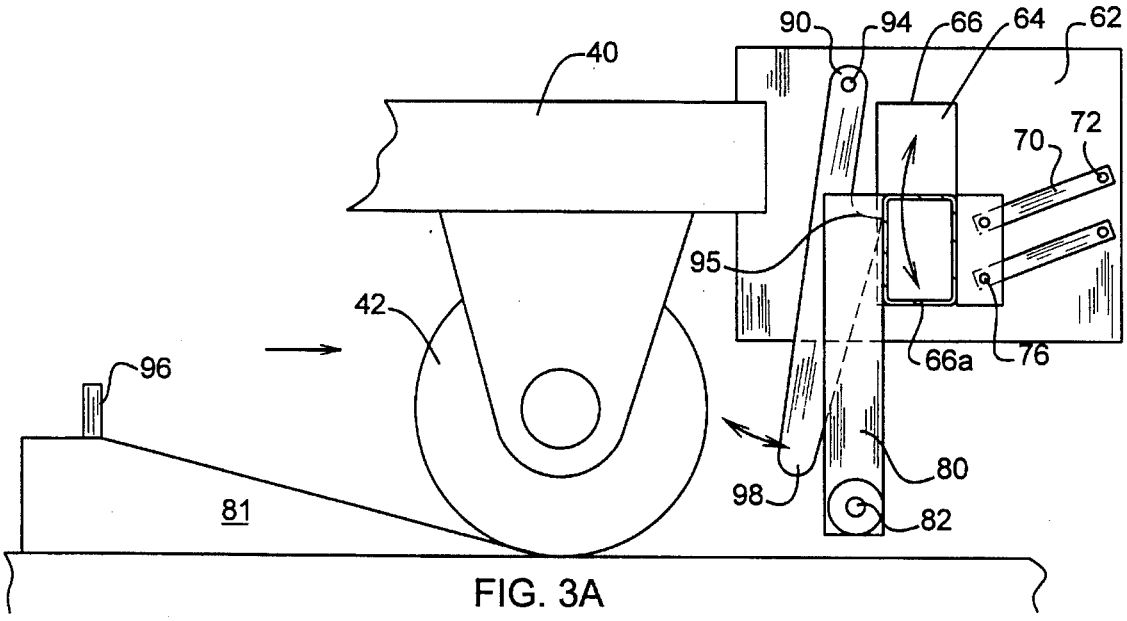
FIG. 3A is an enlarged side view of the front end of the load carrying unit seen of FIG. 3 when the vertically movable pin assembly is at its lowered position.

As shown, the support member 66 is vertically movable within spaced slots 64 in spaced vertically extending plate members 62 and is movably attached to at least one of the vertically extending plate members 62 with elongated movable link members 70. Elongated movable link members 70, one pair being shown in FIGS. 2–3A, are pivotally attached to the plate member 62 by pivot pins 72 on one end and on an opposite end are attached to an outwardly extending flange portion 74 of support member 66 by pivot pins 76. Although only one pair of link members 70 are shown, it is realized that on the opposite end of the support member 66 another pair of link members 70 may also be used to attach vertically movable support member 66 to the opposite plate 62.

As best shown in FIGS. 3 and 3A, the movable support member 66 is vertically movable in response to the movement of a cam follower 82. The cam follower 82 is mounted at the lower extremity of vertically extending elongated connecting member 80 which is fixedly attached to the backside of the support member 66. The connecting member 80 is vertically movable in response to the vertical position of cam follower 82. The cam follower 82 may be a roller rotatable along the surface of the cam 81 which is in angular alignment with the chain guide channel 16. Thus, the cam follower 82 is always in the same angle to horizontal as the conveyor guide 16. However, the surface upon which the load carrying unit 12 is moving is generally in a manufacturing plant when the floor is flat or substantially horizontal and the chain 14 is mounted on the floor but at selected locations, such as those locations where fork lifts and the like have to pass over the conveying path, then the chain must be movable beneath the surface of the floor while the cart 12 stays on a horizontal path on the floor surface. This relocation of the vertical height of the conveying path is generally less than 3". This is generally sufficient clearance in most manufacturing facilities.

As shown in FIGS. 1, 3 and 3A, a locking member 90 for the support member 66 may also be provided. As shown, locking member 90 is pivotally attached with pivot pin 94 to one side plate 62 for locking the support member 66 in its uppermost position. The locking member 90 is also provided with a notch 95 therein which is positioned to receive the bottom portion 66*a* of support member 66 therein when the support member 66 is in its uppermost position. As shown in FIG. 3A, cam 81 is provided with a delocking pin 96 which is positioned on the cam 81 at the starting point of decline of the conveying path from its highest elevation. Delocking pin 96 is positioned to engage the lower extremity 98 of locking members 90 at the starting point of decline of the conveyor chain 14 so the support member 66 will be "free" to move downwardly thereby maintaining engagement of pin 44 within conveyor chain 14. Even though two locking members 90 are shown in FIG. 1 it is realized that only one may be utilized.

Figure 4:
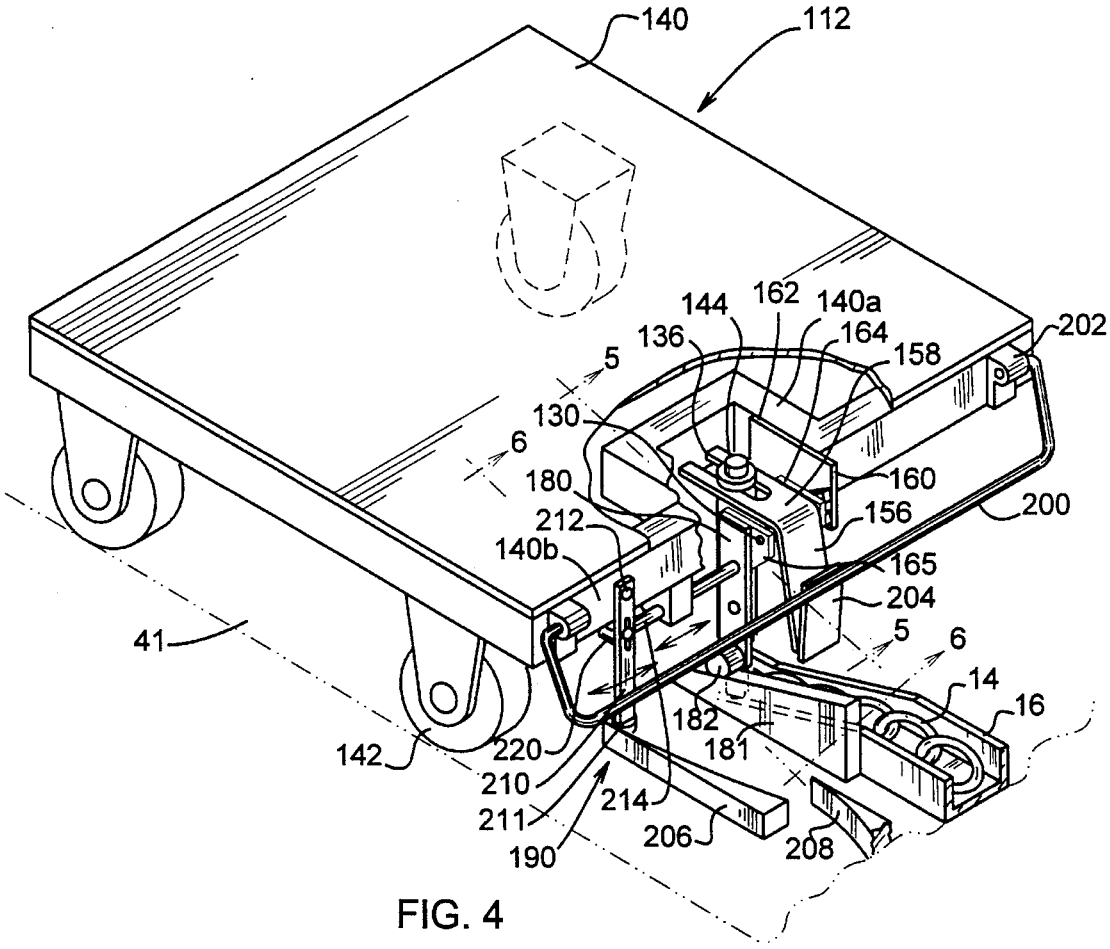
FIG. 4 is a perspective view of another preferred load carrying unit of the present invention shown in engagement with a conveyor chain.

FIG. 4 is a perspective view of another preferred load carrying unit of the present invention shown as a wheeled cart and identified by the numeral 112. The load carrying unit 112 is also conveyed along a conveying path of a conveyor system which includes the endless chain 14 and the chain guide channel 16 which defines the conveying path for the endless chain 14.

The carrying unit 112 comprises a frame structure 140 which is a modification of the load carrying unit 12 of FIG. 1 wherein front end 140*b* of the frame structure 140 is provided with a U-shaped cut-out 140*a*. Attached to the U-shaped cut-out portion 140*a* is a vertically movable pin assembly 160 which includes a flat plate member 162 fixedly attached to the frame structure 140*a*. A vertically movable support member 164 is movably mounted through movable links 170 and pivot pins 172 and 176 to plate 162. Even though plate 162 is shown as a preferred embodiment it is realized that the vertically movable flat plates 164 may be movably attached directly to the frame 140*a*.

A second vertically movable plate 165 spaced from and parallel to the vertically movable plate 164 is also provided and is attached to the plate 164 with an elongated axle 130 which also acts as the axle for the first means to vertically move a chain engaging pin 144 as discussed hereinafter. The parallel spaced plate members 164 and 165 are also fixedly attached to a vertical pin receiving sleeve 145 which receives the vertically movable chain engaging pin 144 therein. The vertical pin receiving sleeve 145 depends vertically from the movable flat plate members 164 and 165 and into the uppermost portion of the guide channel 16. The sleeve 145 terminates above the conveyor chain 14 and has a diameter only sightly less than the width of the guide channel 16 to provide a clearance between sleeve 145 and the guide member 16 so that the sleeve 145 can move linearly in the guide channel 16 as the load bearing units 112 move along the conveyor chain 14. Portions of the movable pin 144 depend from the bottom end of the sleeve 145 so that the depending end of the pin 144 can be received in an opening of one of the horizontal links 24 of the conveyor chain 14.

Figure 5:
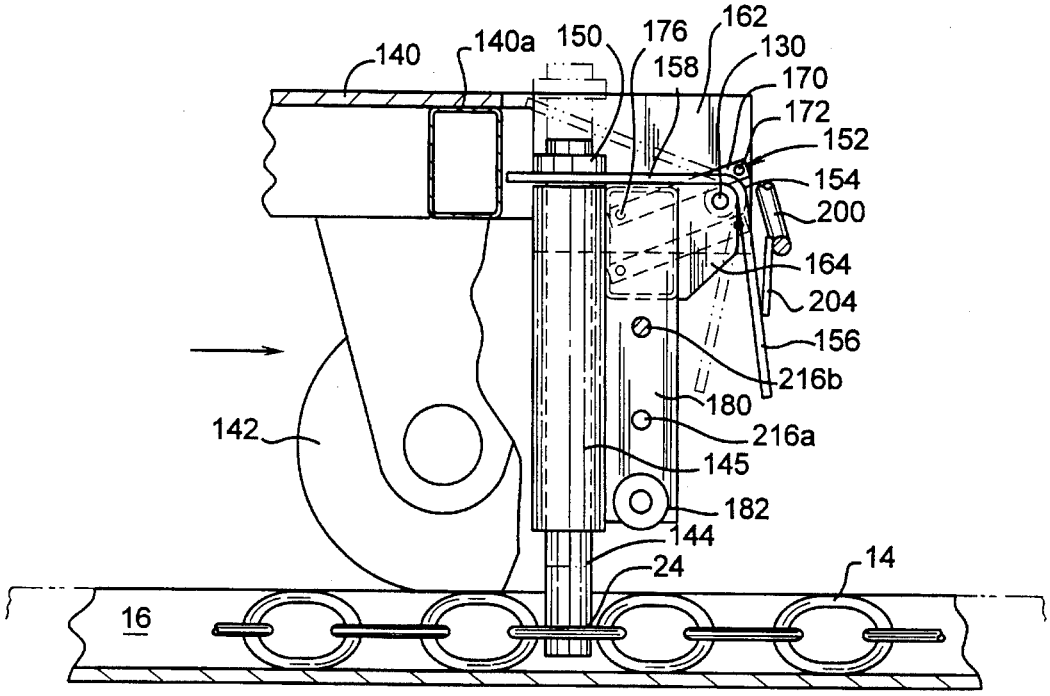
FIG. 5 is an enlarged side view of an element of the load carrying unit as seen in the direction of arrows 5—5 in FIG. 1 when the vertically movable pin assembly of the present invention is at its lowered position.
Figure 5A:
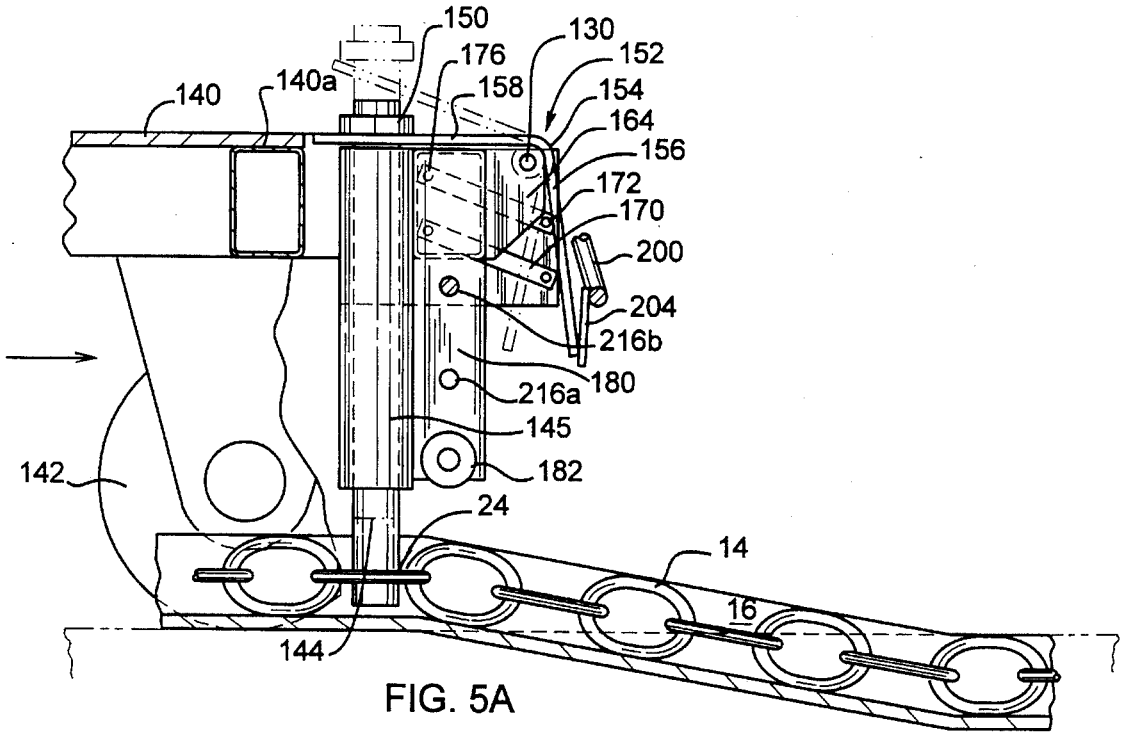
FIG. 5A is an enlarged side view of the preferred vertically movable pin assembly of FIG. 5 when the vertically movable pin assembly is at an elevated position.
Figure 6:
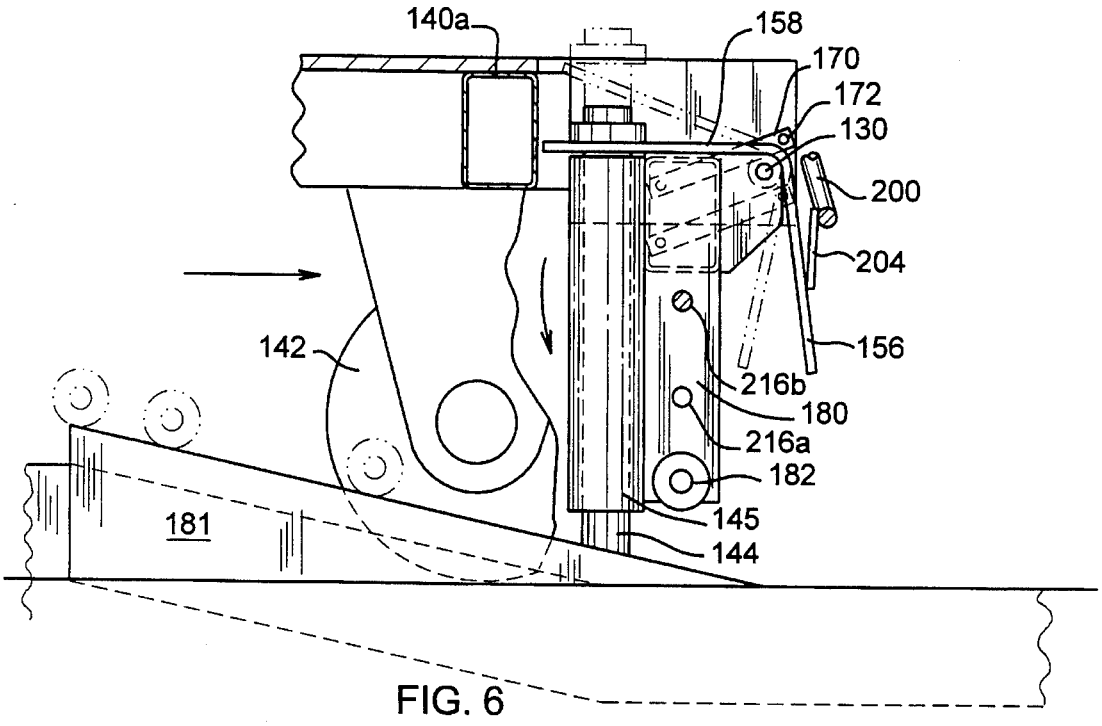
FIG. 6 is an enlarged side view of the front end of the load carrying unit of FIG. 4 as seen in the direction of arrows 6—6 when the vertically movable pin assembly is at its lowered position.
Figure 6A:
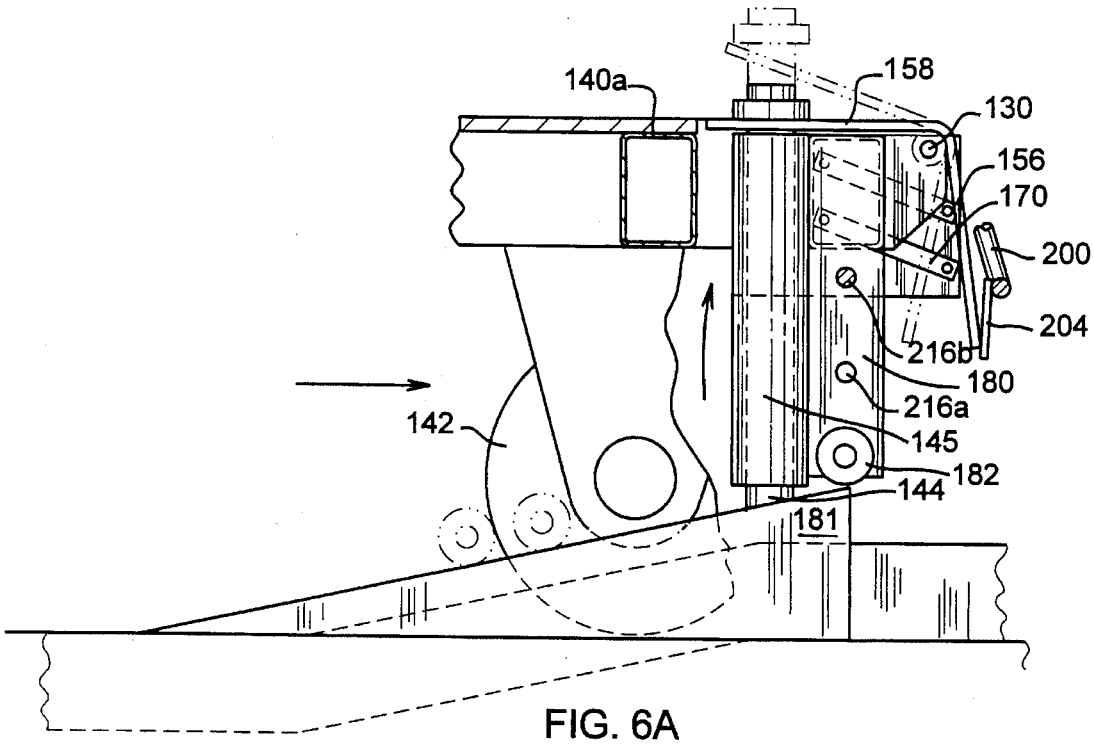
FIG. 6A is an enlarged side view of the front end of the carrying unit seen in FIG. 6 when the load carrying unit is at an elevated position.
Figure 7:
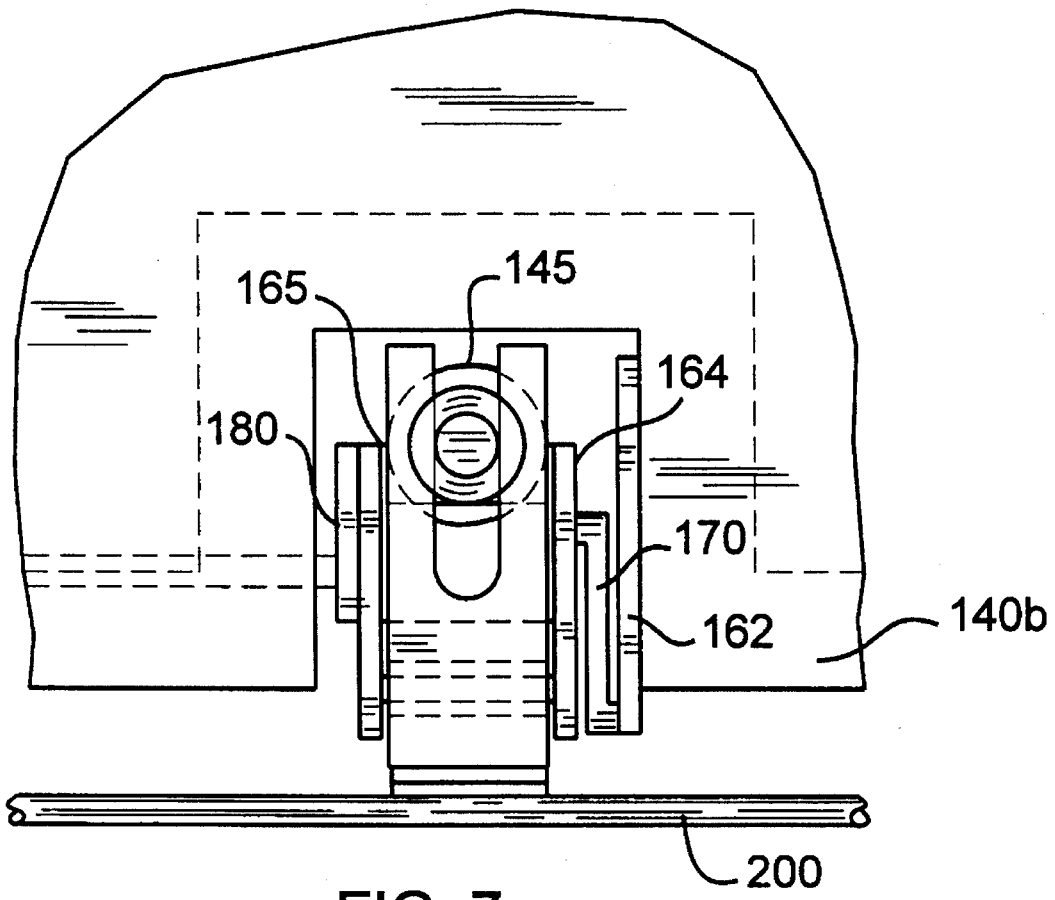
FIG. 7 is a partial top view of the vertically movable pin assembly of the embodiment of the present invention as shown in FIG. 4.

The movable chain engagement pin 144 is movable between a lower, conveyor chain engaged position (shown in solid lines in FIGS. 5–6A) and a raised, vertically disengaged position (shown in broken lines in FIGS. 5–6A). In the lowered, conveyor chain engagement position the depending end of the pin 144 is received, as shown in the figures in the opening of one of the horizontal links 24 of the conveyor chain 14. And, in the raised conveyor chain disengaged position the depending end of the pin 144 is spaced a distance above and out of contact with the conveyor chain 14 so that the conveyor chain 14 moves beneath the depending end of the pin 144. Movable pin actuating means 152 is similar to the movable pin actuating means 52 of the load carrying unit 12 of FIG. 1. Movable pin actuating means 152 comprises a pivotable right angle plate 154 pivotally mounted on the front side 140*a* of the frame structure 140. The angled plate 154 includes a first arm 156 and a second arm 158 at a right angle to the first arm 156. The pivot axle 130 is located across the plate 154 at the junction of the first arm 156 and the second arm 158 and is fixed thereto so that the plate 154 will move with the axle 130 as it rotates. As shown in FIG. 4, the opposite ends of the axle 130 extend beyond the opposite lateral sides of plate 154 and are received in appropriate holes which are disposed in plates 164 and 165, as noted hereinbefore. The first arm 156 depends from the axle 130 at the front end of the vertically movable pin assembly 160 and the second arm 158 extends back from the axle 130 and is in engagement with the movable pin 144. The second arm 158 is formed with an elongated opening or slot 136 and the upwardly extending portion of the pin 144 is received in the elongated opening 136 with a pin keeper 150 located above the second arm 158 so that it is in abutment with the top side of the second arm 158 when pin 144 is in its lowered, engaged position. The conveyor engagement pin 144 is movable to the lower conveyor chain engagement position by the force of gravity.

As shown in FIGS. 5–6A, movable plates 164 and 165 are vertically movable in response to the movement of a cam follower 182. The cam follower 182 is connected to the lower extremity of an elongated connecting member 180 which is fixedly attached to the vertically movable plate member 165, connecting member 180 being mounted for vertical movement in response to the position of cam follower 182. The cam follower 182 is in following cooperating relation with the surface of cam 181 which is in parallel relationship with the conveying path of the chain guide channel 16. Thus, the cam follower 182 is always in the same angle to horizontal as the chain guide channel 16.

Also, as shown in FIG. 4 a locking assembly 190 is provided to lock the vertically movable pin assembly 160 in its uppermost or elevated position and its lowermost position when the chain guide channel 16 is located beneath the surface of the floor 41 upon which the load carrying unit 140 is in contact. The locking assembly 190 is provided with a vertically extending leg member 210 attached to the frame structure 140*b* by pivot pin 212. The vertically extending leg member 210 terminates at its lower portion with a cam follower 211. The cam follower 211 is movable in response to the contour of the cam surface of cams 206 and 208 wherein the cam follower 211 pivots or swings the leg 210 in an arcuate motion depending upon the contour of the cam surfaces. The leg 210 is provided with a slot 218 in its upper portion for receiving a pin 220 of a horizontally extending latching bar 214, movement of bar 214 horizontally being responsive to arcuate movement of leg 210. In one latching position the latching bar 214 is received by opening 216*a* and when the latching bar 214 is in a second latching position latching bar 214 is received by opening 216*b*. However, depending upon the contour of the cam surfaces of cam 206 or cam 208 the locking bar 214 may be in a disengaged position. The contour or configuration of the cam surfaces of the cams 206 and 208 are such that when the endless conveyor chain 14 is either in an incline or a decline the locking bar 214 will be in a disengaged position but when the chain is in a horizontal position at its uppermost or lowermost position the cam surface of cam member 208 pushes leg 210 outwardly thereby forcing the latching bar 214 inwardly into a latching position in either opening 216*a* or 216*b* depending upon whether the chain 14 is in an elevated position or in a lowered position. Cam surface of cam 206 is utilized for disengagement of latching bar 214 from openings 216*a* or 216*b*.

Even further, as shown in FIGS. 4–6A, a safety bar 200 is provided for disengaging the movable pin 144 from the chain 14 of a load carrying unit 112 if the load carrying unit 112 gets too close to or comes upon a load carrying unit which is in a "stop" position. Safety bar 200 is pivotally attached to the front end frame structure 140*b* through collars 202 spaced on opposite sides of the front end of the load carrying unit 112. Safety bar 200 is provided with an downwardly extending finger 204 which is in cooperative relationship with the angled plate 154 of the movable pin actuating means 152. Thus, when the safety arm 200 comes in contact with the rear end of a load carrying unit or another object which is in its path, the safety bar 200 moves inwardly and through the downwardly extending finger 204 engages the first arm of 156 thereby forcing the second arm 158 upwardly moving the movable pin 144 out of engagement with the chain 14.

In operation of the load carrying unit 12, 112 in a conveyor system, the load carrying unit 12, 112 including pin 44, 144 in engagement with the conveying chain 14 moves the load carrying unit 12 along a defined conveying path which is defined by the position of chain guide channel 16. The chain guide channel 16 is generally placed along the floor surface 41 in a manufacturing facility. However, as the load carrying unit 12, 112 moves to a position where chain 14 must be below the floor surface 41, then chain guide channel 16 is positioned below the floor 41. At such locations, the conveying chain 14 moves downwardly into the floor 41 and a cam 81, 181 having a cam surface in parallel with chain guide channel 16 descends beneath the surface of floor 41 at the same angle. Pin 44, 144 which is attached to a vertical movable support member, such as movable support member 66 moves downwardly along with the support member in response to the vertical movement of the cam follower 80, 180. As shown in the example in FIG. 1, upon the conveying path emerging from beneath the floor surface 41, the cam 81 is provided with an inclined surface parallel to the conveying path and the cam follower 82 moves vertically upward thereby repositioning vertical support member 66 and in turn pin 44. As the embodiment of FIG. 1 shows, the vertically movable support member 66 moves up or down and the pin 44, which is in cooperating movable relation with the support member 66, also moves up or down but maintains its engagement with the conveyor chain 14 as the cam 81 is angularly aligned with chain guide channel 16 and in turn, chain 14.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A load carrying unit for selected movement along a conveying path having a first and a second elevation and defined by a conveyor chain, comprising:

a frame structure having a front end and a back end;

floor engaging wheels rotatably attached to the frame structure;

a vertically movable chain engaging pin assembly attached to said front end of said frame structure, said assembly including a chain engaging pin, a first means to move said pin between a lowered chain engaged position whereat the depending end of the pin engages the conveyor chain and a raised, chain disengaged position whereat the depending end of the pin is spaced above and out of contact with the conveyor chain, and a second means to vertically move said first means and said pin in a chain engaged position as a unit between said first elevation and said second elevation.

2. The load carrying unit of claim 1, said second means of said vertically movable chain engaging pin assembly comprising a pair of spaced vertically extending plate members on opposite sides of said front end of said frame structure, each of said plate members having a vertically extending slot, and a vertically movable support member having opposite ends received within said slots, said first means and said pin being vertically movable as a unit in response to movement of said support member.

3. The load carrying unit of claim 2, said support member including at least one forwardly extending flange portion on one end, said flange portion being adjacent to and parallel with one of said vertically extending plate members, said flange portion being attached to said plate member by a movably attached link member.

4. The load carrying unit of claim 1 including means to lock said vertically movable pin assembly at a raised position when said vertically movable pin assembly is in its raised position.

5. The load carrying unit of claim 4, said means to lock including a locking member pivotally attached to said vertically movable chain engaging pin assembly, said locking member having a notch to receive a bottom of a support member when said support member is in its raised position.

6. The load carrying unit of claim 5, said locking member having a lower extremity movable to a de-locking condition in response to a de-locking means disposed at a preselected location on said conveying path.

7. The load carrying unit of claim 1, said vertically movable chain engaging pin assembly including a cam follower attached to said second means, said cam follower being in following cooperation with a cam surface which is in angular parallel alignment with said conveyor chain.

8. A load carrying unit for selected movement along a conveying path defined by a conveyor chain, comprising;

a frame structure having a front end and a back end;

floor engaging wheels rotatably attached to the frame structure;

a vertically movable chain engaging pin; and, means to move vertically said chain engaging pin in a chain engaged position relative to said frame structure in cooperating relation with vertically angular movement of said conveyor chain.

9. The load carrying unit of claim 8 said means to move said chain engaging pin vertically when said conveyor chain moves at an angle comprises a vertically movable chain engaging pin assembly attached to said front end of said frame structure, said assembly including a first means to move said chain engaging pin between a lowered chain engaged position and a raised chain disengaged position and a second means to vertically move said first means and said pin as a unit between a first elevation and a second elevation.

10. The load carrying unit of claim 8, said means to move said chain engaging pin vertically when said conveyor chain moves at an angle including a cam follower cooperatively associated with a cam surface, said cam surface being in parallel alignment with said conveying path.

11. The load carrying unit of claim 8, said means to move said chain engaging pin vertically when said conveyor chain moves at an angle including a pair of spaced vertically extending plate members on opposite sides of said front end of said frame structure, each of said plate members having a vertically extending slot, and a vertically movable support member having opposite ends received within said slots, a vertically movable support member being movable in response to a cam follower, said cam follower being in following cooperation with a cam surface when is an angular, parallel alignment with said conveyor chain.

12. The load carrying unit of claim 8 wherein said means to move vertically said chain engaging pin vertically when said conveyor chain moves at an angle includes a vertically movable pin assembly and locking means, said locking means locking said vertically movable pin assembly at a raised position when said vertically movable pin assembly is in its raised position.

13. The load carrying unit of claim 12, said locking means being a locking member having a lower extremity movable to a locking condition in response to a de-locking means disposed at a preselected location on said conveying path.

14. A load carrying unit for selected movement along a conveying path defined by a conveyor chain, comprising;

a frame structure having a front end and a back end;

floor engaging wheels rotatably attached to the frame structure;

first means to move said chain engaging pin into and out of engagement with said conveyor chain; and, second means to move said chain engaging pin vertically in a chain engaged position relative to said frame structure in cooperating relation with vertically angular movement of said chain.

15. The load carrying unit of claim 14, said second means to vertically move said chain engaging pin including a cam follower cooperatively associated with a cam surface, said cam surface being in parallel angled alignment with said conveying path.

16. The load carrying unit of claim 15 including means to lock said second means to vertically move said chain engaging pin at a raised position when said cam follower is at a preselected vertical position.

* * * * *